US011764010B2

(12) United States Patent
Lee et al.

(10) Patent No.: US 11,764,010 B2
(45) Date of Patent: Sep. 19, 2023

(54) CONTACTOR WITH ARC SUPPRESSOR

(71) Applicant: TE CONNECTIVITY CORPORATION, Berwyn, PA (US)

(72) Inventors: Albert Yong Lee, Greensboro, NC (US); Roger Lee Thrush, Clemmons, NC (US)

(73) Assignee: TE Connectivity Solutions GmbH, Schaffhausen (CH)

( * ) Notice: Subject to any disclaimer, the term of this patent is extended or adjusted under 35 U.S.C. 154(b) by 932 days.

(21) Appl. No.: 16/164,909

(22) Filed: Oct. 19, 2018

(65) Prior Publication Data

US 2020/0126741 A1 Apr. 23, 2020

(51) Int. Cl.

| | |
|---|---|
| ***H01H 33/18*** | (2006.01) |
| ***H01H 50/02*** | (2006.01) |
| ***H01H 50/18*** | (2006.01) |
| ***H01H 50/44*** | (2006.01) |
| ***H01H 50/54*** | (2006.01) |

(52) U.S. Cl.

CPC ..... *H01H 33/182* (2013.01); *H01H 50/02* (2013.01); *H01H 50/18* (2013.01); *H01H 50/44* (2013.01); *H01H 50/546* (2013.01)

(58) Field of Classification Search

CPC ..... H01H 33/182
USPC ..... 335/201
See application file for complete search history.

(56) References Cited

U.S. PATENT DOCUMENTS

| | | | | |
|---|---|---|---|---|
| 6,747,537 | B1 * | 6/2004 | Mosteller | H01F 7/0252 335/302 |
| 7,423,506 | B2 * | 9/2008 | Terasaki | H01F 7/021 335/281 |
| 8,575,508 | B2 * | 11/2013 | Kashiwagi | H01H 9/443 218/23 |
| 8,749,331 | B2 * | 6/2014 | Kashimura | H01H 33/182 335/201 |
| 8,902,026 | B2 * | 12/2014 | Fujita | H01H 33/182 335/201 |
| 9,508,508 | B2 * | 11/2016 | Takaya | H01H 50/04 |
| 9,570,258 | B2 * | 2/2017 | Park | H01H 9/443 |
| 10,727,008 | B2 * | 7/2020 | Hoffmann | H01H 9/443 |
| 2001/0040493 | A1 * | 11/2001 | Bloom | B32B 1/00 335/306 |

(Continued)

FOREIGN PATENT DOCUMENTS

DE 10202628 A1 8/2003

OTHER PUBLICATIONS

International Search Report, International Application No. PCTIB2019/058173, International Filing Date, Sep. 26, 2019.

*Primary Examiner* — Alexander Talpalatski

(57) ABSTRACT

A contactor includes an housing having a cavity, fixed contacts received in the cavity having mating ends in the cavity, a movable contact movable within the cavity between a mated position and an unmated position and engaging the fixed contacts to electrically connect the fixed contacts in the mated position, and a coil assembly in the cavity operated to move the movable contact between the unmated position and the mating position. The contactor includes an arc suppressor in the cavity. The arc suppressor includes a multi-pole magnet having a first magnet having a first pole and a second magnet having a second pole. The first magnet is integrated with the second magnet in a unitary magnet body.

21 Claims, 3 Drawing Sheets

(56) References Cited

U.S. PATENT DOCUMENTS

| | | | | |
|---|---|---|---|---|
| 2011/0120844 | A1* | 5/2011 | Hoffmann | H01H 50/02 200/275 |
| 2012/0181860 | A1 | 7/2012 | Hsu et al. | |
| 2015/0022293 | A1 | 1/2015 | Naka et al. | |
| 2020/0234902 | A1* | 7/2020 | Lee | H01H 50/38 |

* cited by examiner

CONTACTOR WITH ARC SUPPRESSOR

BACKGROUND OF THE INVENTION

The subject matter herein relates generally to high power electrical contactors.

Certain electrical applications, such as HVAC, power supply, locomotives, elevator control, motor control, aerospace applications, hybrid electric vehicles, fuel-cell vehicles, charging systems, and the like, utilize electrical contactors having contacts that are normally open (or separated). The contacts are closed (or joined) to supply power to a particular device. When the contactor receives an electrical signal, the contactor is energized to introduce a magnetic field to drive a movable contact to mate with fixed contacts. During mating and unmating of the movable contact with the fixed contacts, electrical arcing may occur, which may cause damage to the contacts, such as oxidation of the surfaces of the contacts, leading to failure of the contactor over time.

Some known contactors include arc suppressors to suppress the effects of electrical arcing to protect the contacts. For example, individual magnets may be located in the vicinity of the contacts to create electrical fields around the contacts, which extinguishes the electrical arcing. However, assembly of the contactor is difficult. For example, loading of multiple magnets into the contactor may be time consuming and labor intensive. Additionally, the magnets may be improperly loaded or loaded in an improper orientation, such as being loaded in an incorrect polarity direction relative to other magnets leading to malfunctioning or rework.

A need exists for a contactor that overcomes the above problems and addresses other concerns experienced in the prior art.

BRIEF DESCRIPTION OF THE INVENTION

In one embodiment, a contactor is provided including an housing having a cavity, fixed contacts received in the cavity having mating ends in the cavity, a movable contact movable within the cavity between a mated position and an unmated position and engaging the fixed contacts to electrically connect the fixed contacts in the mated position, and a coil assembly in the cavity operated to move the movable contact between the unmated position and the mating position. The contactor includes an arc suppressor in the cavity. The arc suppressor includes a multi-pole magnet having a first magnet having a first pole and a second magnet having a second pole. The first magnet is integrated with the second magnet in a unitary magnet body.

In another embodiment, a contactor is provided including an housing having a cavity, fixed contacts received in the cavity having mating ends in the cavity, a movable contact movable within the cavity between a mated position and an unmated position and engaging the fixed contacts to electrically connect the fixed contacts in the mated position, and a coil assembly in the cavity operated to move the movable contact between the unmated position and the mating position. The contactor includes an arc suppressor in the cavity. The arc suppressor includes a first multi-pole magnet located in the cavity on a first side of the movable contact and a second multi-pole magnet located in the cavity on a second side of the movable contact. The first multipole magnet having a first magnet having a first pole and a second magnet having a second pole. The first magnet of the first multi-pole magnet is integrated with the second magnet of the first multi-pole magnet in a first unitary magnet body. The second multipole magnet has a first magnet having a first pole and a second magnet having a second pole. The first magnet of the second multi-pole magnet is integrated with the second magnet of the second multi-pole magnet in a second unitary magnet body.

In a further embodiment, a contactor is provided including an housing having a cavity, fixed contacts received in the cavity having mating ends in the cavity, a movable contact movable within the cavity between a mated position and an unmated position and engaging the fixed contacts to electrically connect the fixed contacts in the mated position, and a coil assembly in the cavity operated to move the movable contact between the unmated position and the mating position. The contactor includes an arc suppressor in the cavity. The arc suppressor includes a multi-pole magnet having a first magnet having a first pole, a second magnet having a second pole, and a third magnet having a third pole. The second magnet is located between the first and third magnets. The second pole has an opposite polarity as the first and third poles. The first, second, and third magnets are integrated in a unitary magnet body.

DETAILED DESCRIPTION OF THE INVENTION

Figure 1:
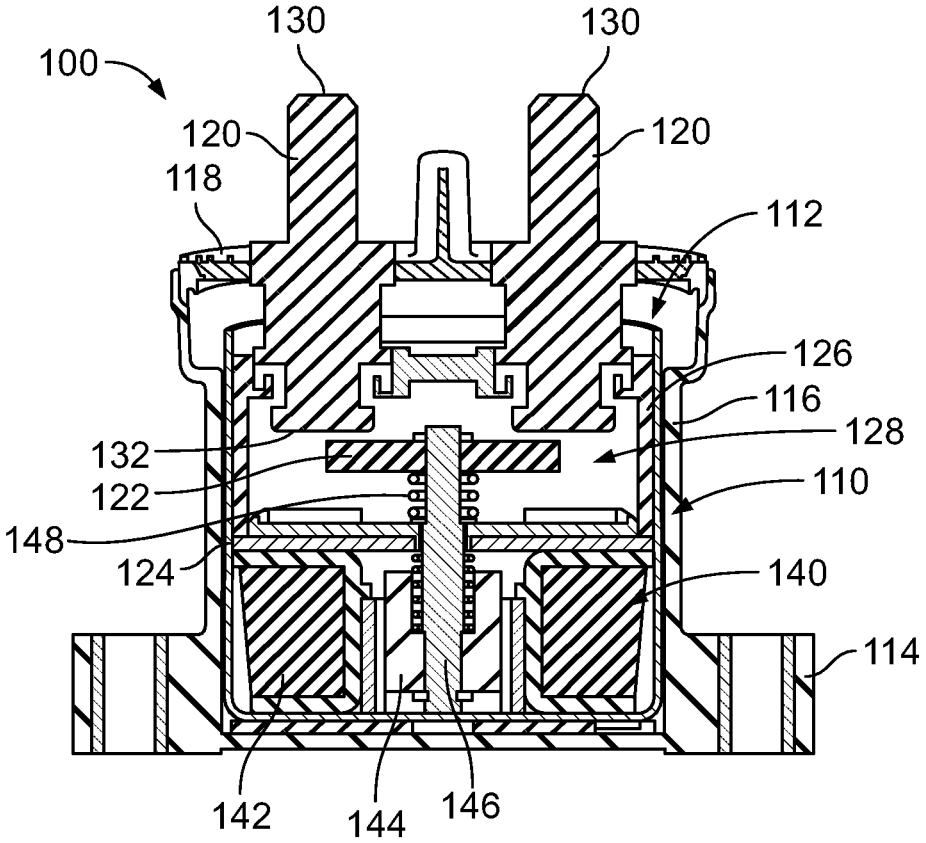
FIG. 1 is a cross-sectional view of a contactor in accordance with an exemplary embodiment.

FIG. 1 is a cross-sectional view of a contactor 100 in accordance with an exemplary embodiment. The contactor 100 is an electrical switch or relay that safely connects and disconnects one or more electrical circuits to protect the flow of power through the system. The contactor 100 may be used in various applications such as HVAC, power supply, locomotives, elevator control, motor control, aerospace applications, hybrid electric vehicles, fuel-cell vehicles, charging systems, and the like.

The contactor 100 includes a housing 110 having a cavity 112. The housing 110 may be a multi-piece housing in various embodiments. The housing 110 includes a base 114 and a header 116 extending from the base 114. Optionally, the base 114 may be configured to be coupled to another component. For example, the base 114 may include mounting brackets for securing the contactor 100 to the other component. In the illustrated embodiment, the header 116 is located above the base 114; however, the housing 110 may have other orientations in alternative embodiments. The housing 110 includes a cover 118 for closing the cavity 112.

For example, the cover 118 may be coupled to the top of the header 116. Optionally, the cover 118 may be sealed to the header 116.

The contactor 100 includes fixed contacts 120 received in the cavity 112 and a movable contact 122 movable within the cavity 112 between a mated position and an unmated position. The movable contact 122 engages the fixed contacts 120 to electrically connect the fixed contacts 120 in the mated position. In the illustrated embodiment, the contactor 100 includes first and second fixed contacts 120; however, the contactor 100 may include greater or fewer fixed contacts in alternative embodiments. The fixed contacts 120 are fixed to the housing 110. For example, the fixed contacts 120 may be coupled to the header 116 and/or the cover 118. In other various embodiments, the fixed contacts 120 may be coupled to an insert 124 of the housing 110 inserted into the cavity 112. The insert 124 may be removable from the cavity 112 when the cover 118 is removed from the header 116. In an exemplary embodiment, the insert 124 of the housing 110 includes a contact holder 126 configured to hold the fixed contacts 120. The contact holder 126 defines an enclosure 128. The fixed contacts 120 extend into the enclosure 128. The movable contact 122 is located in the enclosure 128.

The fixed contacts 120 each include a terminating end 130 and a mating end 132. The terminating end 130 is configured to be terminated to another component, such as a wire or a terminal, such as a line in or a line out wire. In an exemplary embodiment, the terminating end 130 is exposed at the exterior of the contactor 100 for terminating to the other component. The terminating end 130 may be threaded to receive a nut. In the illustrated embodiment, the terminating end 130 extends through the cover 118 and is located above the cover 118. The mating end 132 is located within the cavity 112 for mating engagement with the movable contact 122, such as when the contactor 100 is energized. In the illustrated embodiment, the mating end 132 is generally flat for engaging the movable contact 122. However, the mating end 132 may have other shapes in alternative embodiments, such as a rounded shape to form a mating bump at the mating end 132 for mating with the movable contact 122.

The contactor 100 includes a coil assembly 140 in the cavity 112 operated to move the movable contact 122 between the unmated position and the mated position. The coil assembly 140 includes a winding or coil 142 wound around a core 144 to form an electromagnet. The coil assembly 140 includes a plunger 146 coupled to the core 144. The movable contact 122 is coupled to the plunger 146 and is movable with the plunger 146 when the coil assembly 140 is operated. The coil assembly 140 includes a spring 148 for returning the movable contact 122 to the unmated position when the coil assembly 140 is deenergized.

In an exemplary embodiment, the contactor 100 includes an arc suppressor 160 for suppressing electrical arc of the electrical circuit. The arc suppressor 160 is located in the cavity 112 of the housing 110. Optionally, the arc suppressor 160 may be located in the contact holder 126, such as in or near the enclosure 128. In an exemplary embodiment, the arc suppressor 160 includes magnets creating magnetic fields in the enclosure 128 for suppressing arc created between the movable contact 122 and the fixed contacts 120. In an exemplary embodiment, the contact holder 126 of the insert 124 may be sealed and may be filled with an inert gas for arc suppression.

Figure 2:
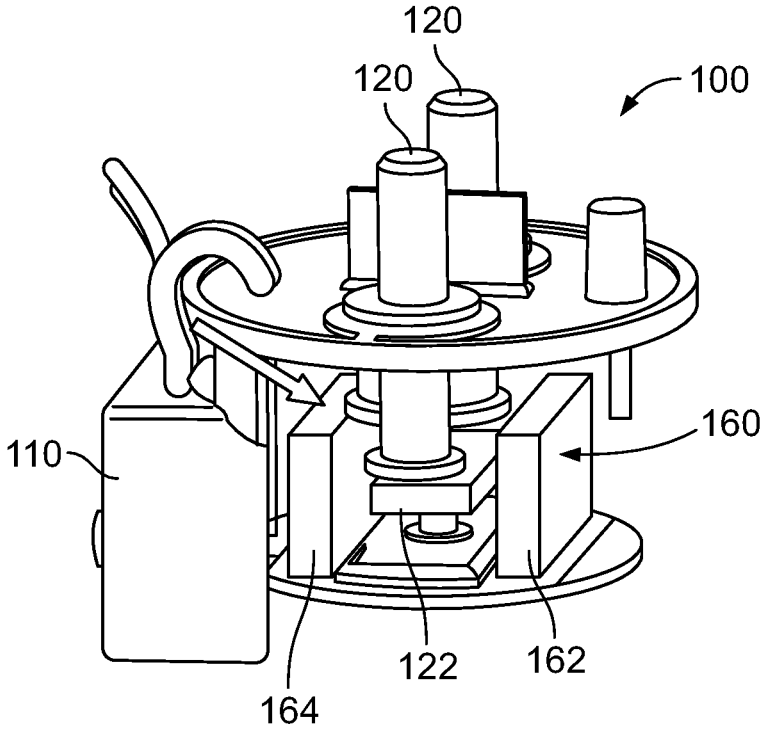
FIG. 2 is a perspective view of a portion of the contactor in accordance with an exemplary embodiment.

FIG. 2 is a perspective view of a portion of the contactor 100 with portions of the housing 110 removed to illustrate the fixed contacts 120 and the movable contact 122. FIG. 2 illustrates the arc suppressor 160 in accordance with an exemplary embodiment. In the illustrated embodiment, the arc suppressor 160 includes a first multi-pole magnet 162 located on a first side of the movable contact 122 and a second multi-pole magnet 164 located on a second side of the movable contact 122. In various embodiments, the arc suppressor 160 may include a single multi-pole magnet, such as the first multiple magnet 162 rather than the pair of multi-pole magnets 162, 164. In other various embodiments, more than two multi-pole magnets may be provided. The multi-pole magnets 162, 164 are located in the vicinity of the fixed contacts 120 and the movable contact 122 for suppressing electrical arcs between the fixed contacts 120 and the movable contact 122 during making or breaking of the electrical circuit.

Figure 3:
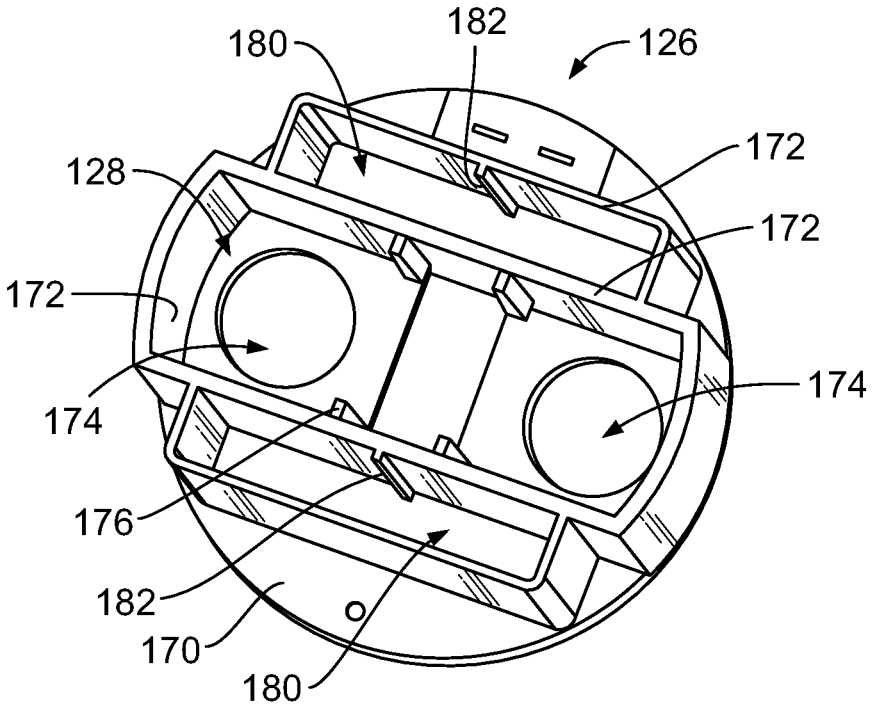
FIG. 3 is a bottom perspective view of a contact holder of the contactor in accordance with an exemplary embodiment.

FIG. 3 is a bottom perspective view of the contact holder 126 in accordance with an exemplary embodiment. The contact holder 126 of the housing 110 includes a base wall 170 and enclosure walls 172 extending from the base wall 170. The enclosure walls 172 define the enclosure 128 that receives the movable contact 122. Optionally, the base wall 170 may be located above the enclosure 128 with the enclosure walls 172 extending below the base wall 170. The base wall 170 includes contact openings 174 receiving the fixed contacts 120 (shown in FIG. 1). Optionally, the contact holder 126 may include guide walls 176 extending from the enclosure walls 172 to engage and guide the movable contact 122 within the enclosure 128.

In an exemplary embodiment, the enclosure walls 172 define magnet slots 180 that receive corresponding multi-pole magnets 162, 164 of the arc suppressor 160. The magnet slots 180 are sized and shaped to receive the multi-pole magnets 162, 164. In the illustrated embodiment, the magnet slots 180 are rectangular shaped; however, the magnet slots 180 may have other shapes in alternative embodiments. In an exemplary embodiment, the contact holder 126 includes keying features 182 extending into the magnet slots 180. The keying features 182 may be used to orient the multi-pole magnets 162, 164 within the magnet slots 180. In the illustrated embodiment, the keying features 182 are centered within the magnet slots 180. However, the keying features 182 may be offset in alternative embodiments for orienting the multi-pole magnets 162, 164 within the magnet slots 180. Optionally, the keying features 182 may have different locations in the different magnet slots 180 for allowing/restricting proper loading of the multi-pole magnets 162, 164 and the proper magnet slots 180.

Figure 4:
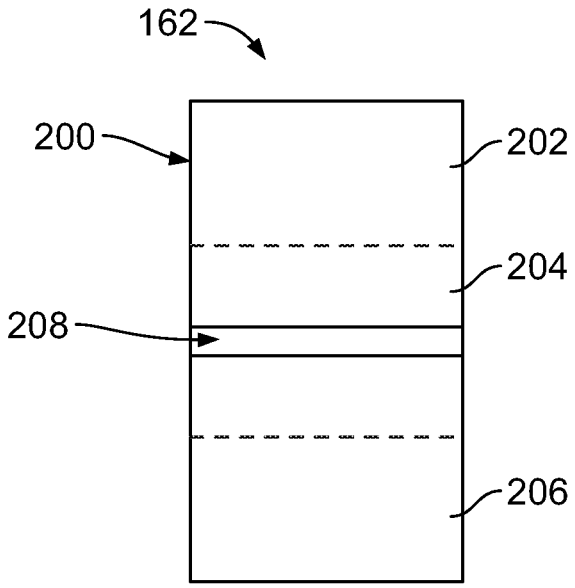
FIG. 4 is a front view of a multi-pole magnet of the contactor in accordance with an exemplary embodiment.
Figure 5:
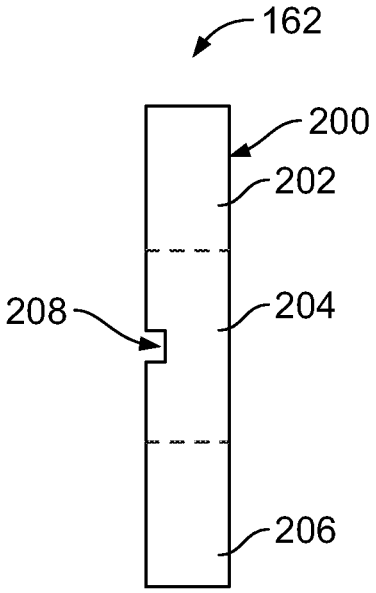
FIG. 5 is a side view of the multi-pole magnet in accordance with an exemplary embodiment.

FIG. 4 is a front view of the multi-pole magnet 162 in accordance with an exemplary embodiment. FIG. 5 is a side view of the multi-pole magnet 162 in accordance with an exemplary embodiment. The multi-pole magnet 162 includes a plurality of magnets having different poles being integrated into a unitary magnet body 200. The unitary magnet body 200 includes the various magnets being held together as a single unit. The unitary magnet body 200 defines a monolithic structure wherein the plurality of magnets are coupled or formed together as part of the unitary magnet body 200. Physical manipulation of any one of the magnets causes corresponding physical manipulation of the other magnet(s) of the multi-pole magnet 162. For example, transferring of the multi-pole magnet 162 into the magnet slots 180 (shown in FIG. 3) or removing of the multi-pole magnet 162 from the magnet slot 180 allows transfer of all of the magnets of the multi-pole magnet 162 as a unitary structure. Individual magnets do not need to be physically transferred relative to each other.

In the illustrated embodiment, the multi-pole magnet 162 includes a first magnet 202 having a first pole, a second magnet 204 having a second pole, and a third magnet 206 having a third pole. The second magnet 204 is located between the first and third magnets 202, 206. In an exemplary embodiment, the second pole has an opposite polarity as the first and third poles, whereas the first pole has the same polarity as the third pole. The first magnet 202, the second magnet 204, and the third magnet 206 are integrated in the unitary magnet body 200. In an exemplary embodiment, the magnets 202, 204, 206 are extruded with each other to form the unitary magnet body 200. For example, the magnets 202, 204, 206 may be neodymium magnets co-extruded to form the unitary magnet body 200. In other various embodiments, the magnets 202, 204, 206 are separately manufactured and secured together to form the unitary magnet body 200. For example, the magnets 202, 204, 206 may be integrated by other means, such as being joined together using glue, welding, or other means. The magnets may be magnetically attracted to each other. In other various embodiments, the magnets 202, 204, 206 may be overmolded or wrapped, such as by a plastic outer body to form the unitary magnet body 200. Optionally, the first and second magnets 202, 204 may directly interface or engage with each other and the second and third magnets 204, 206 may directly interface or engage with each other.

In an exemplary embodiment, the unitary magnet body 200 includes one or more keying features 208. In the illustrated embodiment, the keying feature 208 is a groove formed in the front of the unitary magnet body 200. Optionally, the keying feature 208 may be centered within the unitary magnet body 200. In other various embodiments, the keying feature 208 may be offset rather than being centered. In various embodiments, the keying features may be provided at the front and the rear of the unitary magnet body 200. The keying features may be located at other locations in alternative embodiments. In other various embodiments, rather than being a groove, the keying feature 208 may be a rib or protrusion extending outward from one or more surfaces of the unitary magnet body 200. The keying feature 208 may be defined by other walls or surfaces of the unitary magnet body 200 in other various embodiments. For example, the top and/or the bottom and/or the sides may be angled or chamfered to define keying features.

Figure 6:
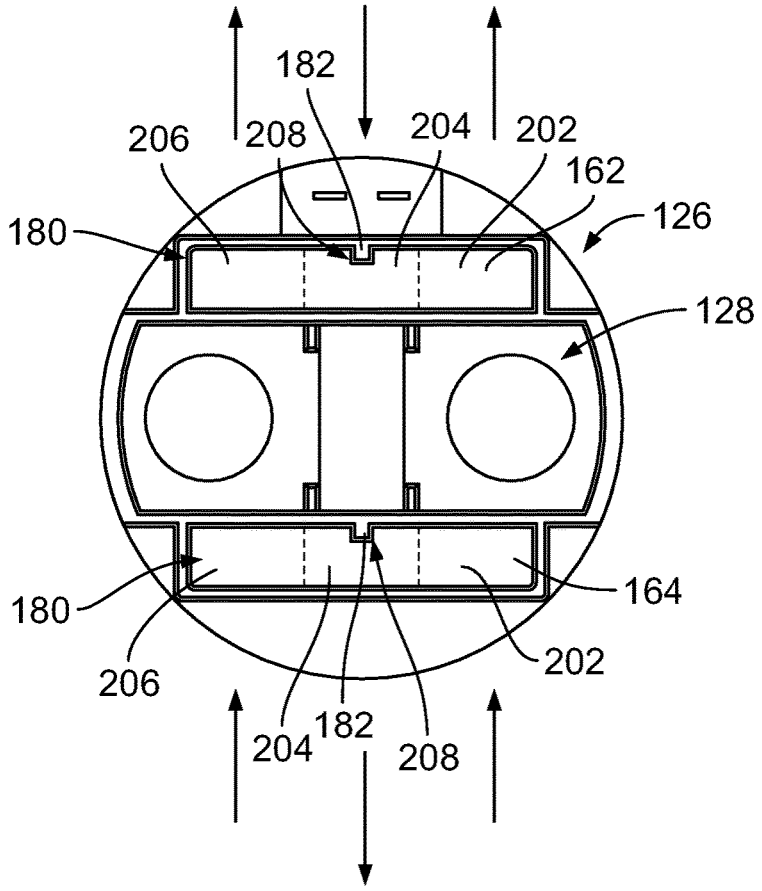
FIG. 6 is a bottom view of the contact holder illustrating the multi-pole magnets.

FIG. 6 is a bottom view of the contact holder 126 illustrating the multi-pole magnets 162, 164 in the magnet slots 180 on opposite sides of the enclosure 128. The magnets 202, 204, 206 forming the unitary magnet body 200 of the first multi-pole magnet 162 may be loaded into and removed from the magnet slot 180 as a unitary structure. Similarly, the magnets 202, 204, 206 forming the unitary magnet body 200 of the second multi-pole magnet 164 may be loaded into and removed from the magnet slot 180 as a unitary structure. The keying features 208 interact with the keying features 182 and the corresponding magnet slots 180 to orient the multi-pole magnets 162, 164 in the magnet slots 180.

In an exemplary embodiment, the first pole (first magnet 202) of the first multi-pole magnet 162 is aligned with the first pole (first magnet 202) of the second multi-pole magnet 164 and have the same polarity to create a magnetic field through the enclosure 128. The second pole (second magnet 204) of the first multi-pole magnet 162 is aligned with the second pole (second magnet 204) of the second multi-pole magnet 164 and have the same polarity to create a magnetic field through the enclosure 128. The third pole (third magnet 206) of the first multi-pole magnet 162 is aligned with the third pole (third magnet 206) of the second multi-pole magnet 164 and have the same polarity to create a magnetic field through the enclosure 128. Optionally, the second pole may have opposite polarity as the first and third poles. Other arrangements are possible in alternative embodiments. Optionally, the multi-pole magnet 162 may be positioned in the contact holder 126 with the first and third poles configured to be aligned with the fixed contacts 120 (shown in FIG. 1).

Figure 7:
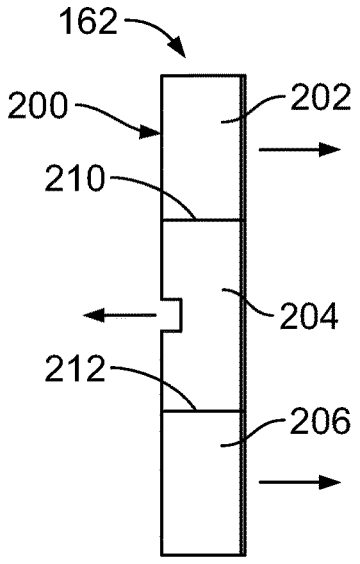
FIG. 7 is a side view of the multi-pole magnet in accordance with an exemplary embodiment.

FIG. 7 is a side view of the multi-pole magnet 162 in accordance with an exemplary embodiment showing the magnets 202, 204, 206 joined together at interfaces 210, 212 to form the unitary magnet body 200. For example, the first and second magnets 202, 204 may be glued or welded together at the first interface 210 and the second and third magnets 204, 206 may be glued or welded together at the second interface 212.

Figure 8:
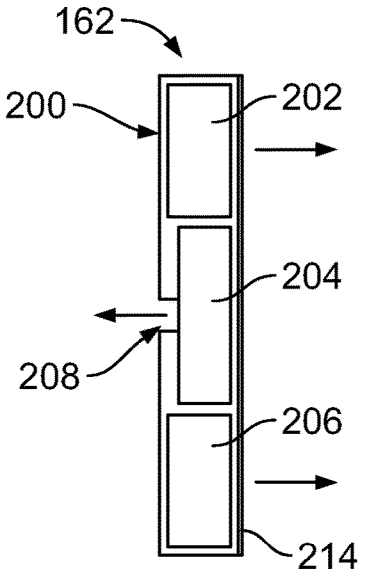
FIG. 8 is a side view of the multi-pole magnet in accordance with an exemplary embodiment.

FIG. 8 is a side view of the multi-pole magnet 162 in accordance with an exemplary embodiment showing the magnets 202, 204, 206 joined together by an overmolded body 214 to form the unitary magnet body 200. The overmolded body 214 in cases the magnets 202, 204, 206. The overmolded body 214 defines the keying feature 208.

Figure 9:
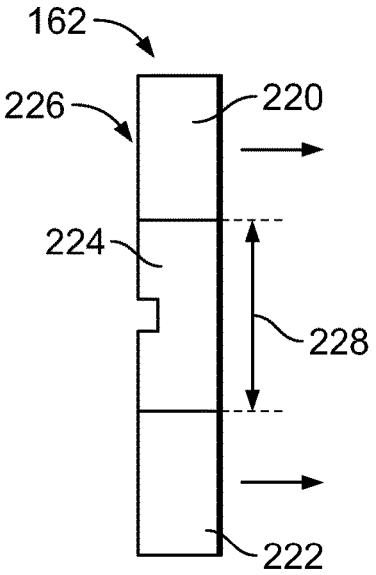
FIG. 9 is a side view of the multi-pole magnet in accordance with an exemplary embodiment.

FIG. 9 is a side view of the multi-pole magnet 162 in accordance with an exemplary embodiment. In the illustrated embodiment, the multi-pole magnet 162 includes a first magnet 220 having a first pole and a second magnet 222 having a second pole. Optionally, the multi-pole magnet 162 may be positioned in the contact holder 126 (shown in FIG. 3) with the first and second poles aligned with the fixed contacts 120. The multi-pole magnet 162 includes a body portion 224 between the first magnet 220 and the second magnet 222. The body portion 224 is nonmagnetic. The first magnet 220, the second magnet 222, and the body portion 224 define a unitary magnet body 226 of the multi-pole magnet 162. The unitary magnet body 226 is devoid of any magnet in the body portion 224 such that one or more magnetic gaps 228 may be formed between the first pole and the second pole. The magnetic gap 228 may be approximately centered along the unitary magnetic body 226. Optionally, the magnetic gap 228 may be positioned between the fixed contacts 120 (FIG. 1). In other various embodiments, the magnetic gap 228 may be at other locations along the unitary magnetic body 226. Optionally, the first pole and the second pole may have a same polarity. In an alternative embodiment, the first pole and the second pole may have opposite polarity.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A contactor comprising:

an housing having a cavity;

fixed contacts received in the cavity, the fixed contacts having mating ends in the cavity;

a movable contact movable within the cavity between a mated position and an unmated position, the movable contact engaging the fixed contacts to electrically connect the fixed contacts in the mated position;

a coil assembly in the cavity operated to move the movable contact between the unmated position and the mating position; and an arc suppressor in the cavity, the arc suppressor including a multi-pole magnet having a first magnet having a first pole and a second magnet having a second pole, the first magnet being integrated with the second magnet in a unitary magnet body.

2. The contactor of claim 1, wherein the first and second magnets are extruded with each other to form the unitary magnet body.

3. The contactor of claim 1, wherein the first and second magnets are separately manufactured and secured together to form the unitary magnet body.

4. The contactor of claim 1, wherein physical manipulation of the first magnet relative to the housing causes corresponding physical manipulation of the second magnet relative to the housing.

5. The contactor of claim 1, wherein the arc suppressor further comprises a third magnet having a third pole, the second magnet located between the first and third magnets, the second pole having an opposite polarity as the first and third poles, the first, second, and third magnets being integrated in the unitary magnet body.

6. The contactor of claim 1, wherein the first magnet is spaced apart from the second magnet by a body portion, the body portion being integrated with the first and second magnets in the unitary magnet body, the unitary magnet body being devoid of any magnet in the body portion such that a magnetic gap is formed between the first pole and the second pole.

7. The contactor of claim 1, wherein the first and second poles have opposite polarity.

8. The contactor of claim 1, wherein the unitary magnet body includes a keying feature for orienting the multi-pole magnet in the housing.

9. The contactor of claim 1, wherein the housing includes a magnet slot receiving the multi-pole magnet therein.

10. The contactor of claim 9, wherein the first and second magnets are received in the magnet slot.

11. The contactor of claim 1, wherein the multi-pole magnet is a first multi-pole magnet on a first side of the movable contact, the arc suppressor further comprising a second multi-pole magnet located in the cavity on a second side of the movable contact, the second multi-pole magnet having a first magnet having a first pole and a second magnet having a second pole, the first magnet of the second multi-pole magnet being integrated with the second magnet of the second multi-pole magnet and a second unitary magnet body.

12. The contactor of claim 11, wherein the first pole of the first multi- pole magnet is aligned with the first pole of the second multi-pole magnet and the second pole of the first multi-pole magnet is aligned with the second pole of the second multi-pole magnet, the first pole of the first multi-pole magnet having a same polarity as the first pole of the second multi-pole magnet and the second pole of the first multi-pole magnet having a same polarity as the second pole of the second multi-pole magnet.

13. A contactor comprising:

an housing having a cavity;

fixed contacts received in the cavity, the fixed contacts having mating ends in the cavity;

a movable contact movable within the cavity between a mated position and an unmated position, the movable contact engaging the fixed contacts to electrically connect the fixed contacts in the mated position;

a coil assembly in the cavity operated to move the movable contact between the unmated position and the mating position; and an arc suppressor in the cavity, the arc suppressor including a first multi-pole magnet located in the cavity on a first side of the movable contact and a second multi-pole magnet located in the cavity on a second side of the movable contact, the first multipole magnet having a first magnet having a first pole and a second magnet having a second pole, the first magnet of the first multi-pole magnet being integrated with the second magnet of the first multi-pole magnet in a first unitary magnet body, the second multipole magnet having a first magnet having a first pole and a second magnet having a second pole, the first magnet of the second multi-pole magnet being integrated with the second magnet of the second multi-pole magnet in a second unitary magnet body.

14. The contactor of claim 13, wherein physical manipulation of the first magnet of the first multi-pole magnet relative to the housing causes corresponding physical manipulation of the second magnet of the first multi-pole magnet relative to the housing independent of the second multi-pole magnet, and wherein physical manipulation of the first magnet of the second multi-pole magnet relative to the housing causes corresponding physical manipulation of the second magnet of the second multi-pole magnet relative to the housing independent of the first multi-pole magnet.

15. The contactor of claim 13, wherein the first multi-pole magnet further comprises a third magnet having a third pole, the second magnet of the first multi-pole magnet located between the first and third magnets of the first multi-pole magnet, the second pole of the first multi-pole magnet having an opposite polarity as the first and third poles of the first multi-pole magnet, the first, second, and third magnets of the first multi-pole magnet being integrated in the unitary magnet body.

16. The contactor of claim 13, wherein the first magnet of the first multi-pole magnet is spaced apart from the second magnet of the first multi-pole magnet by a body portion, the body portion being integrated with the first and second magnets in the unitary magnet body of the first multi-pole magnet, the unitary magnet body of the first multi-pole magnet being devoid of any magnet in the body portion such that a magnetic gap is formed between the first pole and the second pole of the first multi-pole magnet.

17. The contactor of claim 13, wherein the housing includes a first magnet slot receiving the first multi-pole magnet therein and a second slot receiving the second multi-pole magnet therein.

18. The contactor of claim 17, wherein the first pole of the first multi-pole magnet is aligned with the first pole of the second multi-pole magnet and the second pole of the first multi-pole magnet is aligned with the second pole of the second multi-pole magnet, the first pole of the first multi-pole magnet having a same polarity as the first pole of the second multi-pole magnet and the second pole of the first multi-pole magnet having a same polarity as the second pole of the second multi-pole magnet.

19. A contactor comprising:

an housing having a cavity;

fixed contacts received in the cavity, the fixed contacts having mating ends in the cavity;

a movable contact movable within the cavity between a mated position and an unmated position, the movable contact engaging the fixed contacts to electrically connect the fixed contacts in the mated position;

a coil assembly in the cavity operated to move the movable contact between the unmated position and the mating position; and an arc suppressor in the cavity, the arc suppressor including a multi-pole magnet having a first magnet having a first pole, a second magnet having a second pole, and a third magnet having a third pole, the second magnet located between the first and third magnets, the second pole having an opposite polarity as the first and third poles, the first, second, and third magnets being integrated in a unitary magnet body.

20. The contactor of claim 19, wherein physical manipulation of the first magnet relative to the housing causes corresponding physical manipulation of the second magnet and the third magnet relative to the housing.

21. The contactor of claim 1, wherein the first and second magnets are arranged along a linear path with the first and second poles facing in opposite directions perpendicular to the linear path.

* * * * *